US005348294A

United States Patent [19]

Shen

[11] Patent Number: 5,348,294

[45] Date of Patent: Sep. 20, 1994

[54] STRING PROTECTING JACKET OF GAME RACKET

[76] Inventor: Walter Shen, 5Fl., No. 412-12, 2 Sec., Chung Shan Rd., Tai Peiping, Tachung, Taiwan

[21] Appl. No.: 185,209

[22] Filed: Jan. 24, 1994

[51] Int. Cl.[5] ..... A63B 49/00

[52] U.S. Cl. ..... 273/73 D

[58] Field of Search ..... 273/73 R, 73 C, 73 D

[56] References Cited

U.S. PATENT DOCUMENTS

| | | | |
|---|---|---|---|
| 5,102,132 | 4/1992 | Chen | 273/730 X |
| 5,137,274 | 8/1992 | Soong | 273/73 D X |
| 5,192,072 | 3/1993 | Hong | 273/730 D X |
| 5,209,472 | 5/1993 | Tseng | 273/73 D X |
| 5,232,219 | 8/1993 | Tseng | 273/73 D |

*Primary Examiner*—Vincent Millin
*Assistant Examiner*—Raleigh W. Chiu

[57] ABSTRACT

A string protecting jacket of a game racket frame comprises a jacket base provided with a plurality of string protecting projections spaced at an interval and dimensioned to fit securely into the string holes of the game racket frame. Each of the string protecting projections is provided axially with a through hole dimensioned to receive therein a string to be strung in the game racket frame. The jacket base body has an upper seat and a lower seat, which have respectively a plurality of horizontal through holes spaced at an interval such that the horizontal through holes can be matched with the through holes of the string protecting projections so as to bring about the stringing of the game racket frame in various manners.

1 Claim, 3 Drawing Sheets

STRING PROTECTING JACKET OF GAME RACKET

BACKGROUND OF THE INVENTION

The present invention relates generally to a string protecting casing of a game racket, and more particularly to a string protecting casing permitting the game racket string to be strung in variable ways.

As shown in FIG. 1, a plurality of string protecting projections 1 of the prior art are inserted respectively into the string holes 3 of the head frame 2 of a game racket. The string holes 3 are formed by drilling after the head frame 2 is made. The drilling operation often results in a rough surface of the string hole 3. The rough surface of the string hole 3 can cause the damage to or the breakage of a string 5 passing through the string hole 3. As a result, the string protecting projection 1 is provided with an axial hole 4 to separate the string 5 from the string hole 3. The string protecting projections 1 are integrally attached to a protecting jacket body 6, which is attached to the outer side surface of the head frame 2 for protecting the head frame 2. There are various methods of stringing the head frame 2, such as the horizontal stringing method as shown in FIG. 1, the bevel stringing method as shown in FIG. 2, Therefore, the construction of the string protecting projection 1 of the prior art must be modified in accordance with the stringing methods mentioned above, thereby calling for a change in design of the molding tool used in making the string protecting projections 1. The retooling of the molding tool is responsible for a substantial increase in the overall cost of making the string protecting projections 1 of the prior art.

SUMMARY OF THE INVENTION

It is therefore the primary objective of the present invention to provide an improved string protecting jacket capable of facilitating various stringing methods without making a change in design of the string holes of a game racket.

In keeping with the principle of the present invention, the foregoing objective of the present invention is attained by an improved string protecting jacket, which comprises a jacket base body provided horizontally along the center line thereof with a plurality of string protecting projections dimensioned to fit securely into the string holes of a game racket. Each of the string protecting projections is provided axially with a through hole in which the string is received. The jacket base body is provided respectively on the upper and the lower sides thereof with a seat having a plurality of horizontal through holes spaced at intervals for facilitating the various stringing methods in conjunction with the through holes of the string protecting jackets.

DETAILED DESCRIPTION OF THE INVENTION

Figure 1:
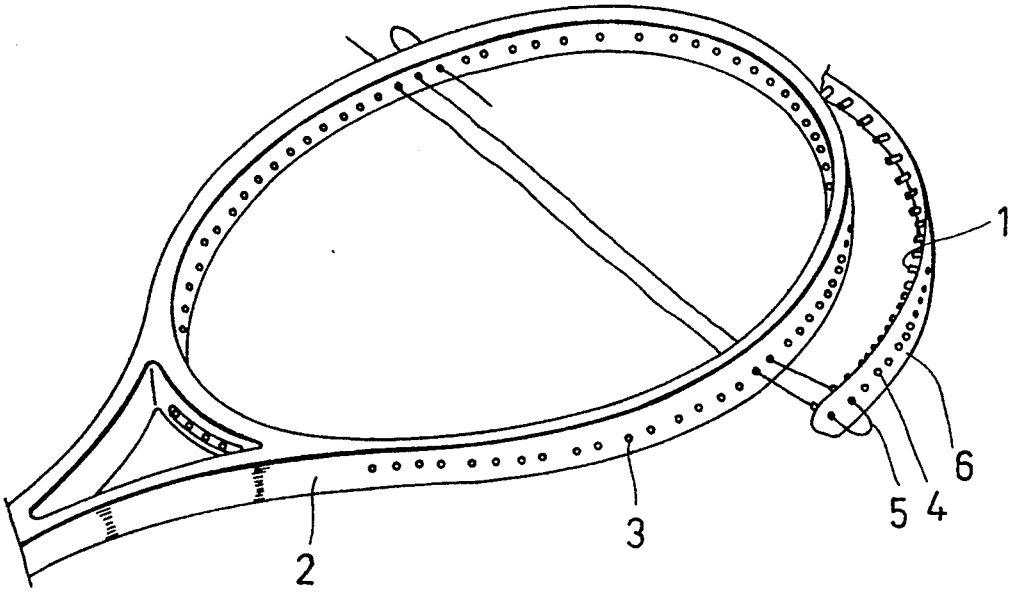
FIG. 1 PRIOR ART
FIGS. 1–2 are schematic views showing various string protecting jackets of game racket frames, according to the prior art.
Figure 2:
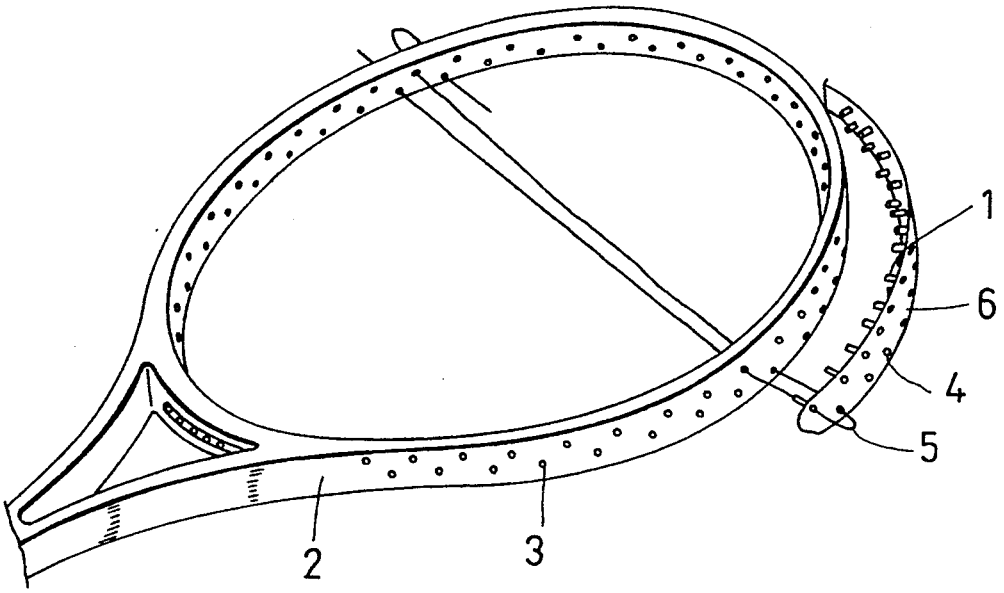
FIG. 2 PRIOR ART
Figure 4:
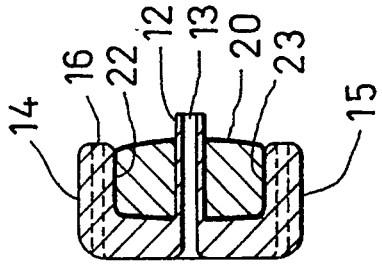
FIG. 4 shows a sectional view of the preferred embodiment in combination, according to the present invention.
Figure 3:
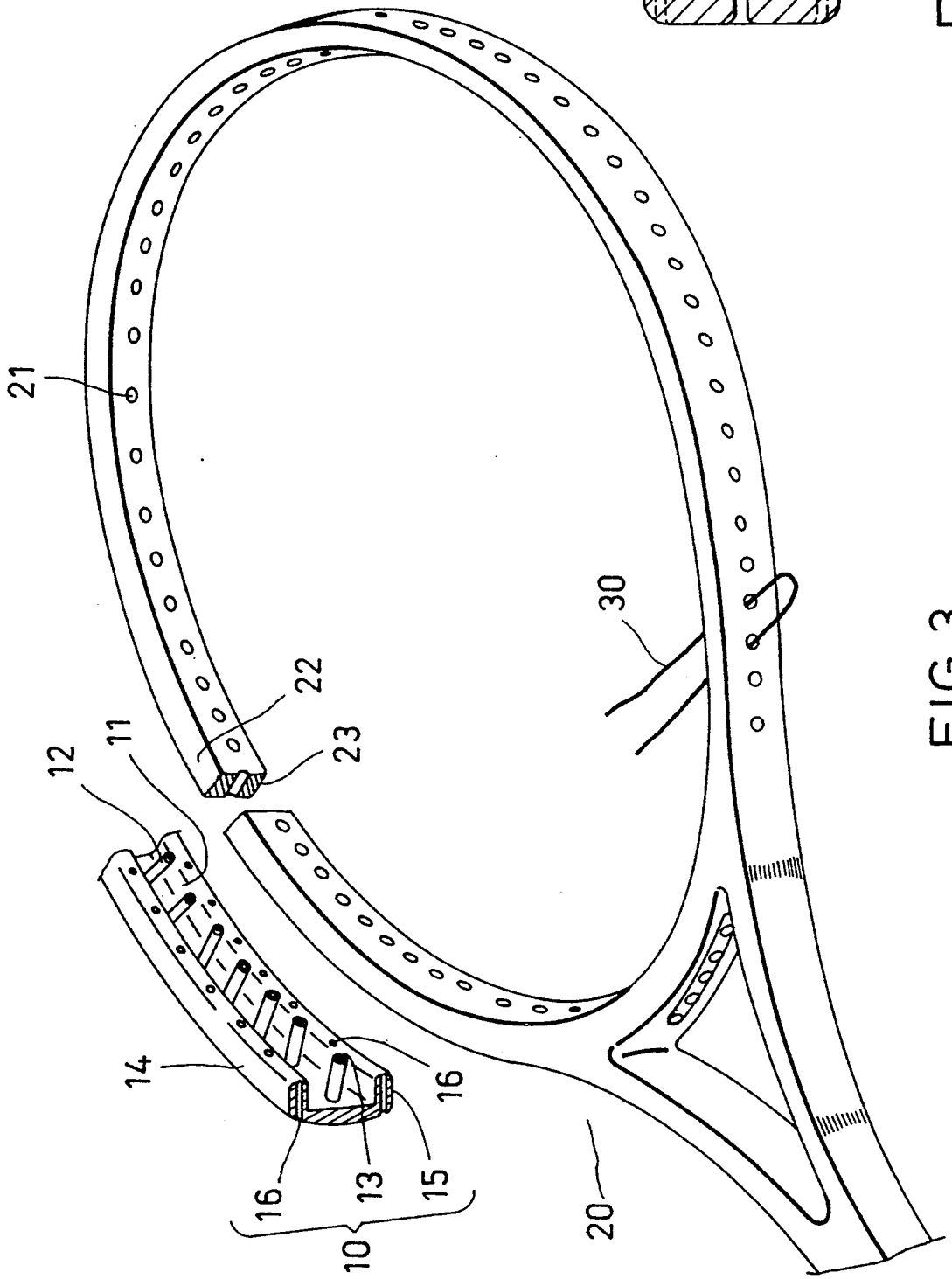
FIG. 3 shows an exploded view of a preferred embodiment of the present invention.
Figure 5:
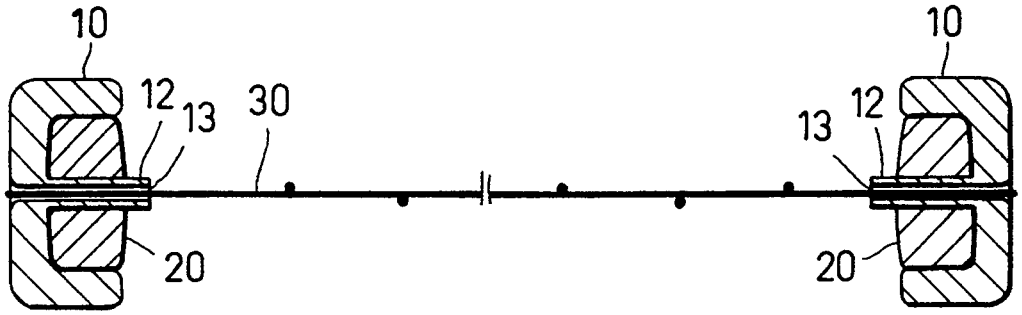
FIGS. 5–7 are side elevational views of the preferred embodiment of the present invention, illustrating the stringing method in accordance with the present invention.
Figure 6:
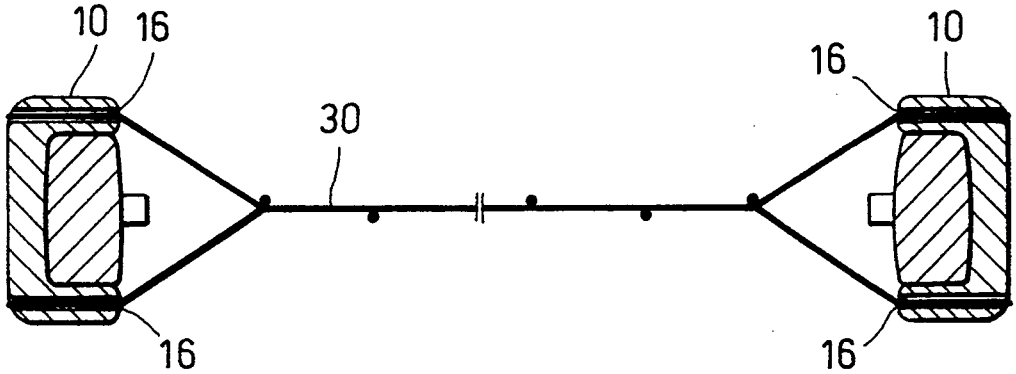
Figure 7:
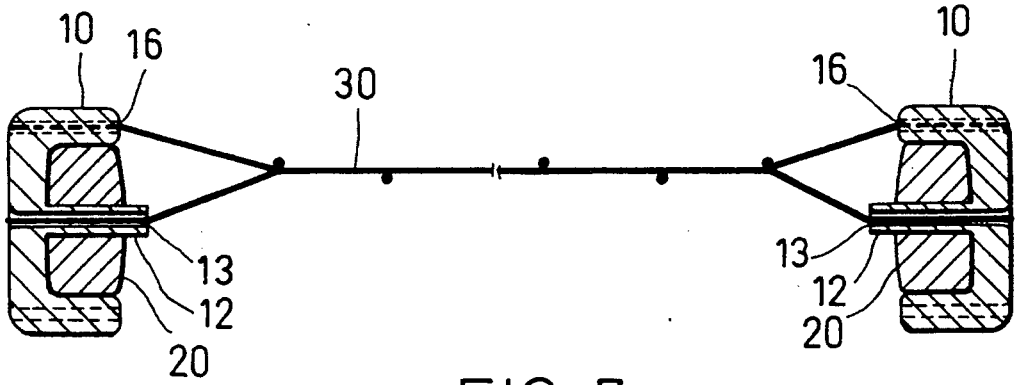

As shown in FIG. 3, a jacket base body to of the present invention is made integrally of a plastic material by injection molding. The jacket base body 10 is made in pieces of various lengths and provided along the horizontal center line 11 thereof with a plurality of string protecting projections 12 spaced at a predetermined interval and dimensioned to fit securely into string holes 21 of a game racket frame 20. Each of the string protecting projections 12 is provided axially with a through hole 13 to receive therein a string 30. The jacket base body 10 is provided respectively on the upper and the lower sides thereof with an upper seat 14 and a lower seat 15, which are arranged respectively at a predetermined distance from the horizontal center line 11 of the jacket base body 10. The upper seat 14 and the lower seat 15 are provided respectively with a plurality of horizontal through holes 16 spaced at a predetermined interval such that the horizontal through holes 16 are aligned with the through holes 13 of the string protecting projections 12. In addition, the horizontal through holes 16 may be so arranged that they alternate with the through holes 13. The string protecting projections 12 are dimensioned to fit securely into the horizontal string holes 21 of the game racket frame 20 such that the upper seat 14 and the lower seat 15 of the jacket base body 10 rest respectively against the upper edge 22 and the lower edge 23 of the game racket frame 20. If the horizontal stringing method is called for, the string 30 is put through in sequence a series of through holes 13 of the string protecting projections 12. Thereafter, the string 30 is tightened. Appropriately. In case the bevel stringing method is called for, the string 30 is put through a series of horizontal through holes 16 of the upper seat 14 in such a manner that one or two horizontal through holes 16, which are adjacent to the horizontal through hole 16 receiving therein the string 30, are bypassed ,as shown in FIGS. 5–7. Similarly, the string 30 is put through a series of horizontal through holes 16 of the lower seat 15. As the strung string 30 is tightened appropriately, the upper and the lower seats 14 and 15 of the jacket base body to are caused to make an intimate contact with the game racket frame 20. In other words, the game racket frame 20 can be strung by the bevel stringing method without providing the game racket frame 20 with the string holes that are drilled obliquely, thanks to the present invention. In case only a portion of the game racket frame 20 is to be strung by the-bevel stringing method, a piece of the jacket base body 10 having a length corresponding to the length of the portion of the game racket frame 20 is fitted around that portion of the game racket frame 20. The stringing of the game racket frame 20 is then proceeded in accordance with the method described above. The horizontal through holes 16 of the upper seat 14 and the lower seat 15 can serve to accomplish any specific method of stringing the game racket frame 20 without specific string holes. Furthermore, the jacket base body 10 of the present invention does not undermine in any way the mechanical strength of the game racket frame 20.

The embodiment of the present invention described above is to be regarded in all respects as merely illustrative and not restrictive. Accordingly, the present invention may be embodied in other specific forms without deviating from the spirit thereof. The present invention is therefore to be limited only by the scope of following appended claim

What is claimed:

1. A string protecting jacket of a game racket frame comprising a jacket base body with a horizontal center line;

said jacket body including a plurality of string protecting projections spaced in intervals to fit securely into the string holes of a game racket frame;

wherein each of said string protecting projections is provided axially with a through hole to receive therein a string to be strung in said game racket frame;

wherein said jacket base body is provided on the upper and the lower sides thereof with an upper seat and a lower seat, respectively, which are arranged at a distance from said horizontal centerline of said jacket body;

each of said upper seat and said lower seat having a plurality of horizontal through holes spaced in intervals throughout the seats such that said horizontal through holes match said through holes of said string protecting projections so that the game racket frame can be strung in various manners.

* * * * *